US005915296A

United States Patent [19]

Itakura

[11] Patent Number: 5,915,296

[45] Date of Patent: Jun. 29, 1999

[54] MULTI-SLIDE MACHINE PRESS

[75] Inventor: Hideo Itakura, Kanagawa, Japan

[73] Assignee: Aida Engineering Co., Ltd., Japan

[21] Appl. No.: 08/896,401

[22] Filed: Jul. 18, 1997

[30] Foreign Application Priority Data

Nov. 11, 1996 [JP] Japan ..... 8-314172

[51] Int. Cl.[6] ..... B30B 1/26

[52] U.S. Cl. ..... 100/209; 72/404; 74/44; 100/237; 100/282

[58] Field of Search ..... 100/193, 207, 100/208, 209, 237, 282; 72/404; 74/44

[56] References Cited

U.S. PATENT DOCUMENTS

| | | | |
|---|---|---|---|
| 3,030,878 | 4/1962 | Hölzer | 100/237 |
| 5,069,057 | 12/1991 | Lee | 100/282 |

FOREIGN PATENT DOCUMENTS

| | | | |
|---|---|---|---|
| 0439684 | 8/1991 | European Pat. Off. | 100/282 |
| 2625881 | 12/1976 | Germany | 100/209 |
| 2804806 | 8/1978 | Germany | 100/209 |
| 63-194897 | 8/1988 | Japan | 100/193 |
| 5-8092 | 1/1993 | Japan | 100/282 |

*Primary Examiner*—Stephen F. Gerrity
*Attorney, Agent, or Firm*—Morrison Law Firm

[57] ABSTRACT

In a machine press with at least three slides, the phases for the stroke of a leftmost slide and a rightmost slide are made identical. The strokes for other slides interposed between the leftmost and rightmost slides are out of phase with the leftmost and rightmost slides. The lower dead point of each slide is the point of maximum pressure. Since the difference in phase of the strokes of the slides causes the lower deadpoints of the leftmost and rightmost slides to occur either before or after the lower deadpoints of the other slides, the total instantaneous eccentric load on the multiple slide machine press is reduced.

8 Claims, 3 Drawing Sheets

MULTI-SLIDE MACHINE PRESS

BACKGROUND OF THE INVENTION

The present invention relates to a machine press having a plurality of slides. More specifically, this invention relates to the coordination of pressing operations for each slide in a machine press having a plurality of slides.

In multi-slide machine presses that automatically perform multiple processing steps, the crank angle to be used in pressing must be within a fixed range based on the part to be processed. When a conveying device is used for the part to be processed, the pressing operation and the conveying operation of the part to be processed must be completed within a single cycle of operation at the machine press to maximize the efficiency of the press. When pressing is performed with a larger number of slides simultaneously, the processing load on the machine press increases.

In general, the nominal pressure of the machine press is based on a symmetrical distribution within a certain radius from the center of the machine press. Thus, when there is an eccentric load or an extremely concentrated load, there may be greater deformation of the machine press, an increase in vibrations, or more noise. The load from a pressing operation being performed by one slide may affect the others, possibly resulting in decreased precision. The slides being used for pressing operations requiring a high degrees of precision may be operated at decreased precision because of the eccentric loads or extremely concentrated loads.

One method of solving the problems associated with eccentric loads and extremely concentrated loads is to increase the size and strength of the various parts of the machine press, including the drive mechanism and the drive source, to handle the increased processing load required to drive the plurality of slides. This increases the cost of the press which limits the efficiency of a multi-slide press.

OBJECTS AND SUMMARY OF THE INVENTION

An object of the present invention is to provide a multi-slide machine press which overcomes the problems of the prior art described above.

It is another object of the present invention to provide a multi-slide machine press that prevents decreases in precision due to eccentric loads without increasing the cost of the press.

Another object of the present invention is to provide a multi-slide machine press in which the lifespan of dies used is increased.

It is yet another object of the present invention to provide a multi-slide machine press which reduces the power requirements and the strength requirements of the drive.

To overcome the problems described above, the present invention comprises a machine press having multiple slides driven by a single drive source. The machine press comprises at least three slides that move up and down via connecting rods connected to independently driven eccentric shafts. The left slide and right slide are operated with matching phases. The other slides interposed between the left and right slides are moved up and down slightly out of phase with the left and right slides. The lower dead point of each slide is the point of maximum pressure on the slide. In the present invention, the drive for the multi-slide press is not required to exert maximum pressure on each of the slides simultaneously. Since the slides interposed between the left and right slides are out of phase with the left and right slides, the lower dead point of the left and right slides occurs either before or after the lower dead point of the slides interposed between the left and right slides. Therefore, the present invention does not have to exert maximum pressure on each slide simultaneously.

Briefly, in a machine press with at least three slides, the phases for the stroke of a leftmost slide and a rightmost slide are made identical. The strokes for other slides interposed between the leftmost and rightmost slides are out of phase with the leftmost and rightmost slides. The lower dead point of each slide is the point of maximum pressure. Since the difference in phase of the strokes of the slides causes the lower dead point of the leftmost and rightmost slides to occur either before or after the lower dead points of the other slides, the total instantaneous eccentric load on the multiple slide machine press is reduced.

The multi-slide machine press comprises: a drive gear disposed on a drive shaft driven by a drive source; a rear main gear driven directly by the drive gear or via at least three pinions disposed on a intermediate shaft comprising a intermediate gear that meshes with the drive gear; a rear eccentric shaft to which the rear main gear is fixed and which is rotatably disposed on bearings disposed on the frame; and a front eccentric shaft to which a front main gear meshing with the rear main gear is fixed and which is rotatably disposed on bearings disposed on the frame; front and rear connecting rods rotatably disposed on the eccentric section of the front and rear eccentric shafts; and a slide connecting to the front and rear connecting rods and moving upper and down while being guided by the frame.

According to an embodiment of the present invention, there is disclosed, a multi-slide machine press, comprising: at least three slides having dies for a machining operation, a drive source mounted on said machine press, a transmission connecting said drive source to said slides such that rotation of drive source results in up and down motion of said at least three slides, and a stroke of an outer two of said at least three slides being out of phase with a stroke of another of said at least three slides located between said outer two, such that said a lower dead point of said stroke of said outer two slides occurs at a different time than a lower dead point of said stroke of said another of said at least three slides.

According to another embodiment of the present invention, there is disclosed, a multi-slide machine press, comprising: a drive source mounted on said machine press, at least three slides vertically movably mounted in a row on said multi-slide machine press, at least three eccentric shafts corresponding to said at least three slides rotatably mounted in said machine press, each of said at least three eccentric shafts having an eccentric portion, a transmission connecting said drive source to said eccentric shafts, at least three connecting rods corresponding to said at least three slides, one end of each of said at least three connecting rods connected to a corresponding one of said at least three slides, another end of said each of said at least three connecting rods connected to a corresponding eccentric portion of said at least three eccentric shafts, whereby said slides vertically reciprocate when said eccentric shafts are rotated by said drive source, and said eccentric portions of each of said at least three eccentric shafts being aligned such that a stroke of an outer two of said at least three slides is out of phase with a stroke of another slide of said at least three slides between said outer two.

According to yet another embodiment of the present invention, there is disclosed, a machine press having a row of at least three slides, comprising: a drive source mounted on said machine press, a transmission connecting said drive source to said at least three slides such that rotation of said drive source results in a reciprocal vertical motion of said at least three slides, and a stroke of an outer two of said at least three slides being out of phase with a stroke of another of said at least three slides located between said outer two such that a lower dead point of said stroke of said outer two slides occurs at a different time than a lower dead point of said stroke of said another of said at least three slides, said transmission including, an eccentric shaft rotatably mounted above said at least three slides, a main gear fixed to said eccentric shaft, a connecting rod, said connecting rod connected between an eccentric portion of said eccentric shaft and said each one of said at least three slides, a drive shaft rotatably driven by said drive source, and pinion gears fixed on said drive shaft meshed with a corresponding main gear.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
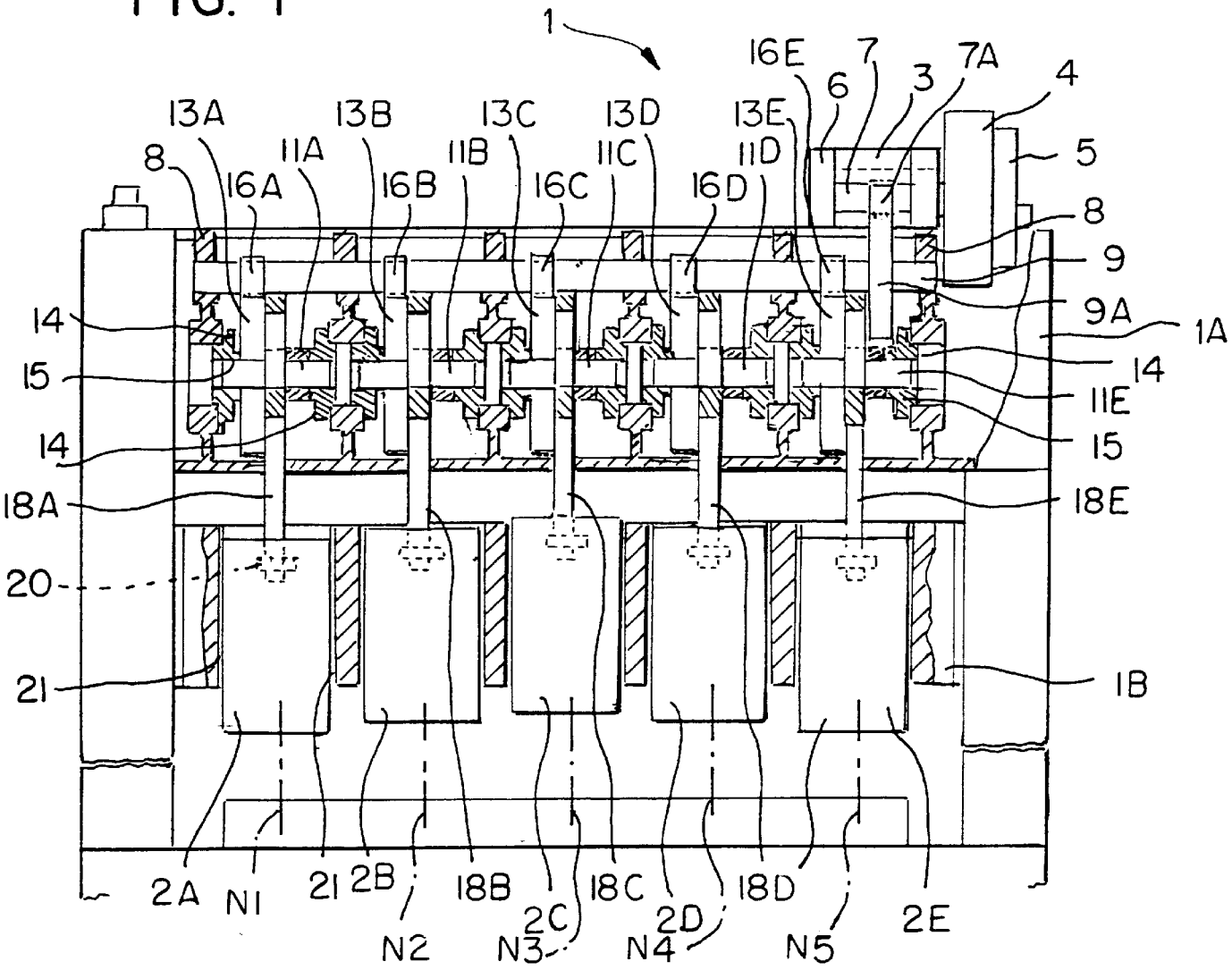
FIG. 1 is a front view cross-section drawing of a multi-slide machine press according to an embodiment of the present invention.
Figure 2:
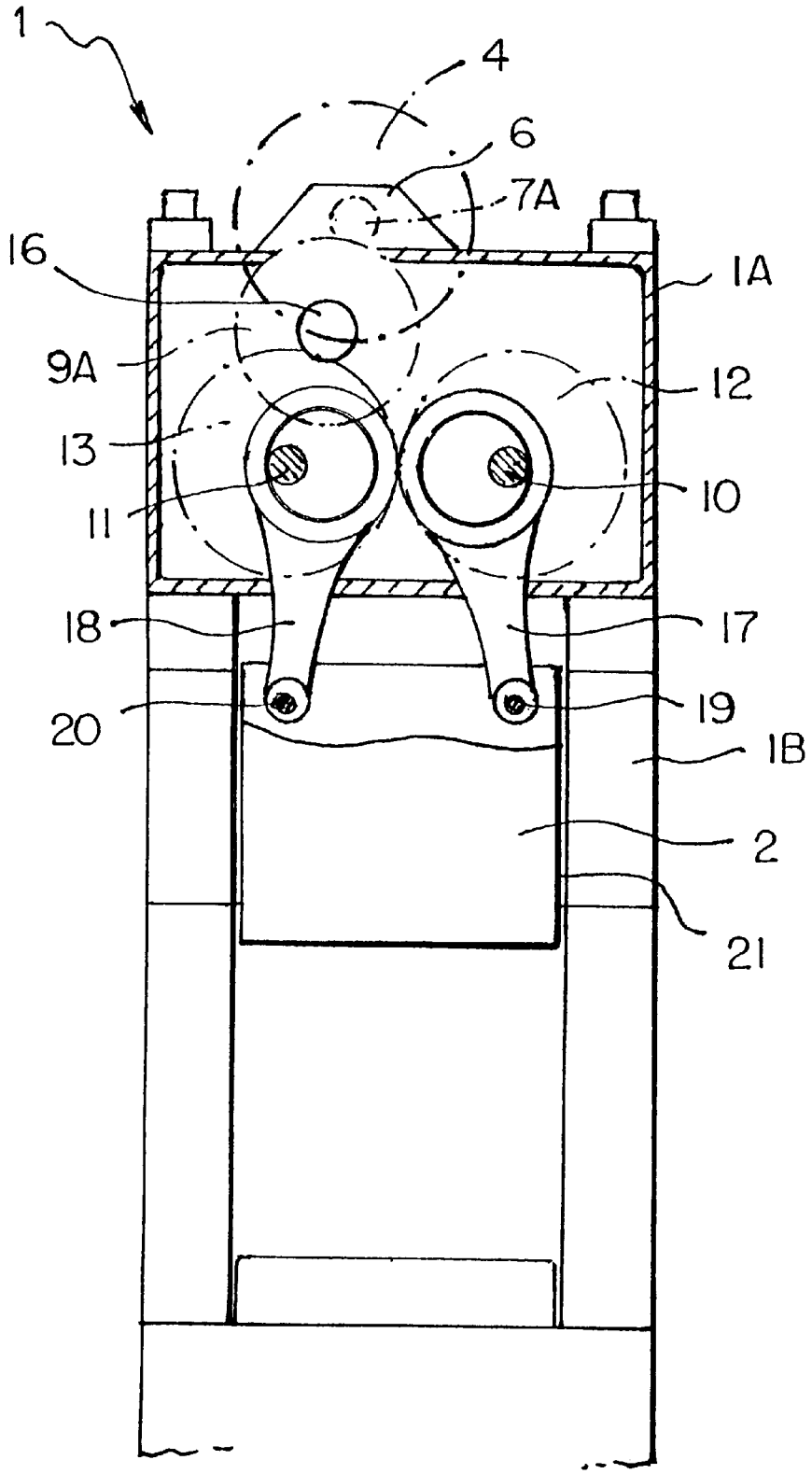
FIG. 2 is a left-side view cross-section drawing of the same machine press.

Referring to FIGS. 1 and 2, a machine press 1 has a first slide 2A, a second slide 2B, a third slide 2C, a forth slide 2D, and a fifth slide 2E (collectively referred to as slides 2A–2E). Machine press 1 further includes stages N1, N2, N3, N4, and N5 (N1–N5) beneath slides 2A–2E, respectively.

A front eccentric shaft 10 and a rear eccentric shaft 11 are rotatably mounted over a front and a rear portion of stages N1–N5. Front eccentric shaft 10 is divided into front eccentric shafts 10OA, 10B, 10C, 10D, and 10E (10A–10E) corresponding to stages N1–N5. Rear eccentric shaft 11 is divided into rear eccentric shafts 11A, 11B, 11C, 11D, and 11E (11A–11E) corresponding to stages N1–N5. Each of front eccentric shafts 10A–10E and rear eccentric shafts 11A–11E are supported by bearings 15 in flanges 14 in a subframe 1A of machine press 1.

Front main gears 12A, 12B, 12C, 12D, and 12E (12A–12E) are fixedly mounted on front eccentric shafts 10A–10E, respectively. Rear main gears 13A, 13B, 13C, 13D, and 13E (13A–13E) are fixedly mounted on rear eccentric shafts 11A–11E, respectively. Rear main gears 13A–13E are meshed with front main gears 12A–12E such that front main gears 12A–12E and rear main gears 13A–13E always rotate simultaneously.

Front connecting rods 17A, 17B, 17C, 17D, and 17E (17A–17E) are rotatably connected to the eccentric sections of front eccentric shafts 10A–10E, respectively. Rear connecting rods 18A, 18B, 18C, 18D, and 18E (18A–18E) are rotatably connected to the eccentric sections of rear eccentric sections 11A–11E, respectively. The lower end of each front connecting rod 17A–17E is connected to a front portion of slides 2A–2E, respectively, by a pin 19. The lower end of each of each rear connecting rod 18A–18E is connected to a rear portion of slides 2A–2E, respectively, by a pin 20.

The driving force of machine press 1 is generated by a motor 3. Motor 3 generates a rotational force which is transferred by a belt (not shown in the figures) to a flywheel 4. The clutch portion of a clutch brake 5 transfers this rotational force to a drive shaft 7. Drive shaft 7 is rotatably held by a bearing unit 5 in machine press 1.

A drive gear 7A is fixedly mounted on drive shaft 7. Drive gear 7A meshes with an intermediate gear 9A. Intermediate gear 9A is fixedly mounted on an intermediate shaft 9. Intermediate shaft 9 is rotatably held in a bearing 8 mounted in a subframe 1A of machine press 1. Pinions 16A, 16B, 16C, 16D, and 16E (16A–16E) are fixedly mounted on machine shaft 9, corresponding to slides 2A–2E. Pinions 16A–16E are meshed with rear main gears 13A–13E, respectively.

The rotation of intermediate drive 9 is transferred to front eccentric shafts 10A–10E and rear eccentric shafts 11A–11E by pinions 16A–16E. The rotation of eccentric shafts 10 and 11 repeatedly raises and lowers slides 2A–2E.

Figure 3:
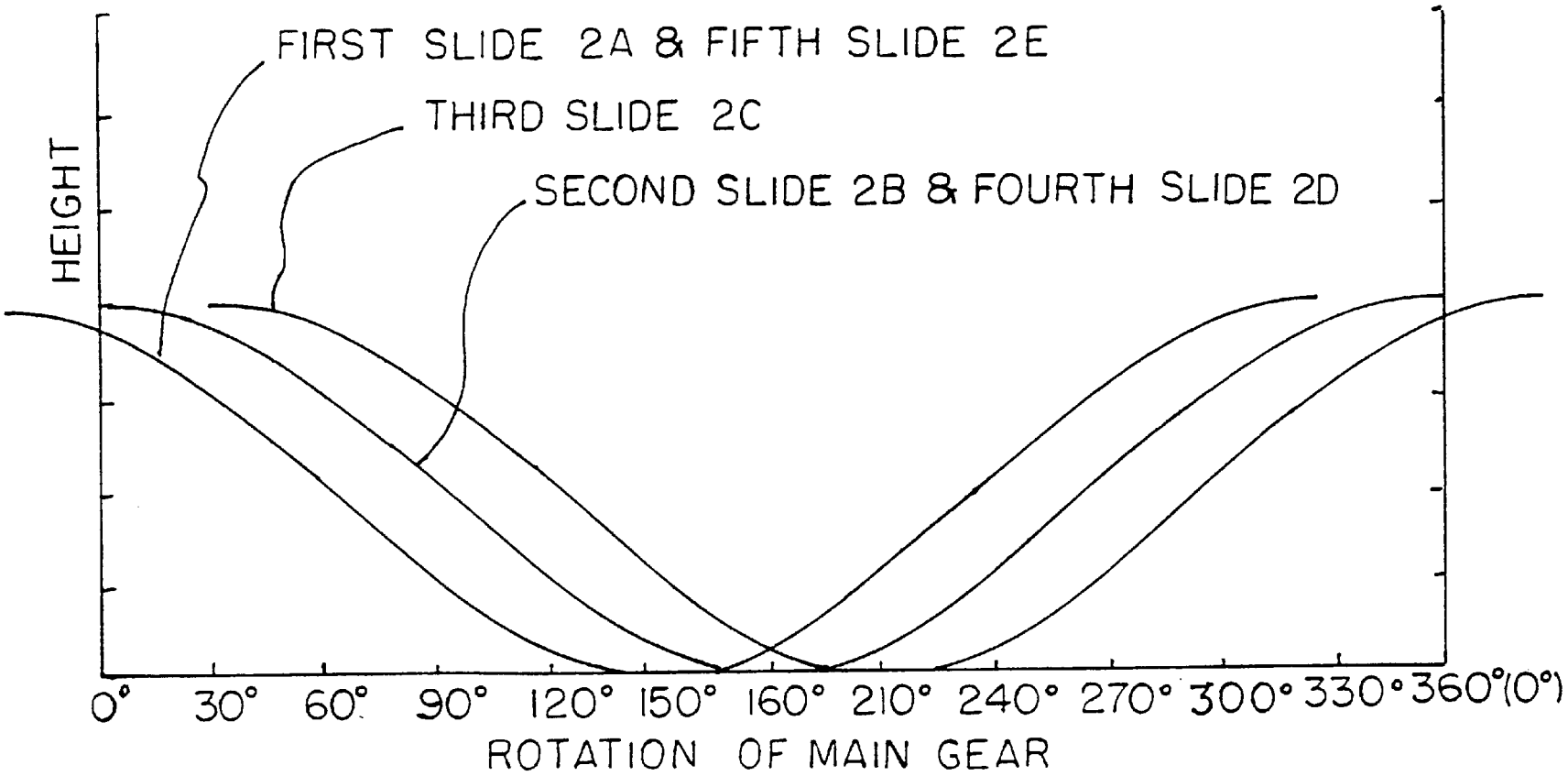
FIG. 3 is a graph of the height of each of the slides against the rotational position of the main gears for one full rotation of the main gears showing the stroke line of each of the slides in a five-slide machine press of the present invention.

Referring now to FIG. 3, first slide 2A and fifth slide 2E are operated at an identical first phase. Second slide 2B and fourth slide 2D are operated at an identical second phase. In the embodiment shown, the second phase is offset from the first phase by 30 degrees. Furthermore, the third slide 2C is operated at a third phase which is offset from the first phase by 60 degrees and offset from the second phase by 30 degrees.

The offset between the first phase, the second phase, and the third phase decreases the eccentric load on front eccentric shaft 10 and rear eccentric shaft 11. For instance, if the first, second, and third phases were equal, then the eccentric load at the instant each slide was at the lower dead point would be much greater than if the phases were offset as in the present invention.

In this embodiment, the eccentricity of eccentric shafts 10, 11 are all identical. However, it would also be possible to use the phase difference at the lower dead point as a guide and change the eccentricity (the stroke length of the slide). It would also be possible to change the deceleration ratio of pinion 16 and main gears 12, 13.

Crank shafts can be used in place of eccentric shafts 10, 11. The deceleration mechanism between drive gear 7A and rear gear 13 can be changed from the bi-level deceleration mechanism used in this embodiment to a single-level deceleration mechanism in which pinions are arranged on the drive shaft to directly mesh with rear gear 13.

In this embodiment, the transfer of power from motor 3 to machine press 1 includes belts, flywheel 4, clutch brake 5, drive shaft 5, gears, 7A, 9A, and pinions 16A–16E. However, any type of transmission can be used which transfers the rotational force generated by motor 3 to rear main gears 13A–13E.

As the description above makes clear, the present invention prevents decreased pressure of some of the slides in a multi-slide machine press caused by eccentric loads and extremely concentrated loads. This improves product precision and increases the lifespan of each die.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A multi-slide machine press, comprising:

at least three slides with dies for machining operations;

a drive source mounted on said machine press;

a transmission connecting said drive source to said at least three slides such that operation of said drive source results in up and down motion of said at least three slides; and a stroke of an outer two of said at least three slides being out of phase with a stroke of another of said at least three slides located between said outer two, such that a lower dead point of said stroke of said outer two slides occurs at a different time than a lower dead point of said stroke of said another of said at least three slides whereby eccentric loading is decreased.

2. The multi-slide machine press of claim 1, wherein each adjacent pair of said at least three slides is out of phase by 30 degrees.

3. The multi-slide machine press of claim 1, further including:

a drive gear disposed on a drive shaft driven by said drive source;

said drive shaft having pinions corresponding to each of said at least three slides;

for said each of said at least three slides, said transmission including;

a rear main gear meshing with a corresponding one of said pinions;

a rear eccentric shaft to which said rear main gear is fixed and rotatably disposed in said multi-slide machine press;

a front main gear meshing with said rear main gear;

a front eccentric shaft to which said front main gear is fixed and rotatably disposed in said multi-slide machine press;

a pair of front and rear connecting rods, one end of each of said pair of front and rear connecting rods rotatably disposed on an eccentric portion of said front eccentric shaft and said rear eccentric shaft, respectively; and another end of said pair of front and rear connecting rods connected to a corresponding one of said at least three slides.

4. The multi-slide machine press of claim 1, further including:

a drive gear fixed to a drive shaft driven by said drive source;

an intermediate gear fixed to an intermediate shaft and meshed with said drive gear;

said intermediate shaft having pinions corresponding to each of said at least three slides;

for said each of said at least three slides, said transmission including;

a rear main gear meshing with a corresponding one of said pinions;

a rear eccentric shaft to which said rear main gear is fixed and rotatably disposed in said multi-slide machine press;

a front main gear meshing with said rear main gear;

a front eccentric shaft to which said front main gear is fixed and rotatably disposed in said multi-slide machine press;

a pair of front and rear connecting rods, one end of each of said pair of front and rear connecting rods rotatably disposed on an eccentric portion of said front eccentric shaft and said rear eccentric shaft, respectively; and another end of said pair of front and rear connecting rods connected to a corresponding one of said at least three slides.

5. A multi-slide machine press, comprising:

a drive source mounted on said machine press;

at least three slides vertically movably mounted in a row on said multi-slide machine press;

at least three eccentric shafts corresponding to said at least three slides rotatably mounted in said machine press, each of said at least three eccentric shafts having an eccentric portion;

a transmission connecting said drive source to said eccentric shafts such that said eccentric shafts rotate when said drive source is operated;

at least three connecting rods corresponding to said at least three slides, one end of each of said at least three connecting rods connected to a corresponding one of said at least three slides;

another end of said each of said at least three connecting rods connected to a corresponding eccentric portion of said at least three eccentric shafts, whereby said slides vertically reciprocate when said eccentric shafts rotate; and said eccentric portions of each of said at least three eccentric shafts being aligned such that a stroke of an outer two of said at least three slides is out of phase with a stroke of another slide of said at least three slides between said outer two whereby eccentric loading is decreased.

6. The multi-slide machine press of claim 5, wherein a stroke of each adjacent pair of said at least three slides is out of phase by 30 degrees.

7. A machine press having a row of at least three slides, comprising:

a drive source mounted on said machine press;

a transmission connecting said drive source to said at least three slides such that operation of said drive source results in a reciprocal vertical motion of said at least three slides; and a stroke of an outer two of said at least three slides being out of phase with a stroke of another of said at least three slides located between said outer two such that a lower dead point of said stroke of said outer two slides occurs at a different time than a lower dead point of said stroke of said another of said at least three slides whereby eccentric loading is decreased;

said transmission including;

an eccentric shaft rotatably mounted above said at least three slides;

a main gear fixed to said eccentric shaft;

a connecting rod, said connecting rod connected between an eccentric portion of said eccentric shaft and said each one of said at least three slides;

a drive shaft rotatably driven by said drive source; and pinion gears fixed on said drive shaft meshed with a corresponding main gear.

8. The multi-slide machine press of claim 7, further including:

an intermediate shaft driven by said drive source; and said drive shaft being driven by said intermediate shaft.

* * * * *